US005279406A

United States Patent [19]

Pawelko et al.

[11] Patent Number: 5,279,406

[45] Date of Patent: Jan. 18, 1994

[54] APPARATUS FOR ALTERING THE SPACING BETWEEN PAIRS OF COAXIAL ROD-SHAPED ARTICLES OF THE TOBACCO PROCESSING INDUSTRY

[75] Inventors: Karl-Heinz Pawelko, Niedermarschacht; Siegfried Schlisio, Geesthacht, both of Fed. Rep. of Germany

[73] Assignee: Körber AG, Hamburg, Fed. Rep. of Germany

[21] Appl. No.: 961,082

[22] Filed: Oct. 14, 1992

[30] Foreign Application Priority Data

Oct. 19, 1991 [DE] Fed. Rep. of Germany ..... 4134663

[51] Int. Cl.[5] ..... B65G 47/26

[52] U.S. Cl. ..... 198/458; 131/282

[58] Field of Search ..... 198/458; 131/282

[56] References Cited

U.S. PATENT DOCUMENTS

| | | | |
|---|---|---|---|
| 2,821,201 | 1/1958 | Brunswig | 198/458 |
| 3,142,372 | 7/1964 | Wiese | 198/458 |
| 3,625,103 | 12/1971 | Giatti | 131/282 |
| 4,200,179 | 4/1980 | Hinz | 198/458 |
| 4,531,629 | 7/1985 | Seragnoli et al. | 198/458 |
| 4,664,249 | 5/1987 | Gherardi | 198/458 |
| 4,913,170 | 4/1990 | Conti | 131/282 |

*Primary Examiner*—Joseph E. Valenza

*Attorney, Agent, or Firm*—Darby & Darby

[57] ABSTRACT

Apparatus for increasing the distance between successive pairs of coaxial plain or filter cigarettes has a first rotary conveyor with axially parallel peripheral flutes which deliver pairs of cigarettes to a transfer station, a second rotary conveyor which receives one cigarette of each pair from the first conveyor by way of a third rotary conveyor and which receives the other cigarette of each pair from a delivering unit positioned to simultaneously move each other cigarette axially of and away from the one cigarette. The delivery unit has two parallel discs which are coupled to each other by cranks having pins provided with flutes for the transfer of other cigarettes from the first conveyor to the second conveyor. The discs rotate about a common axis or about parallel axes inclined relative to the axes of rotation of the first, second and third conveyors. One of the discs receives torque from a gear, a gear transmission or a cardan joint, and the other disc receives torque from the one disc through the cranks.

18 Claims, 4 Drawing Sheets

1
2
3
4
5
6
7
8
9
10
11
11a
12
13
14
15
16
17
17a
17b
18
19
20
21
22
23
24
25
26
27
28
29

Fig.3a
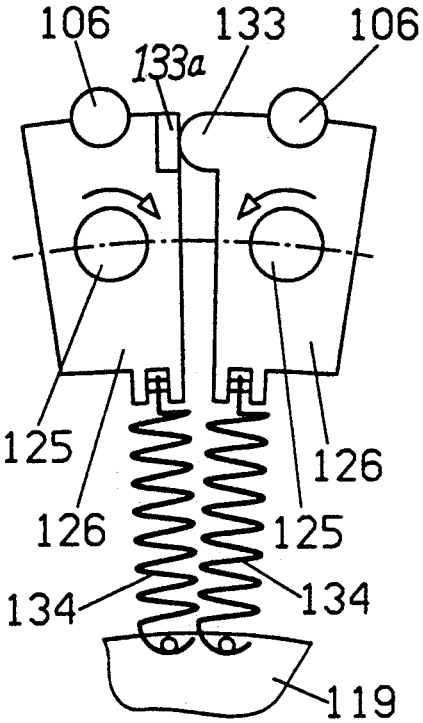
Fig.3b
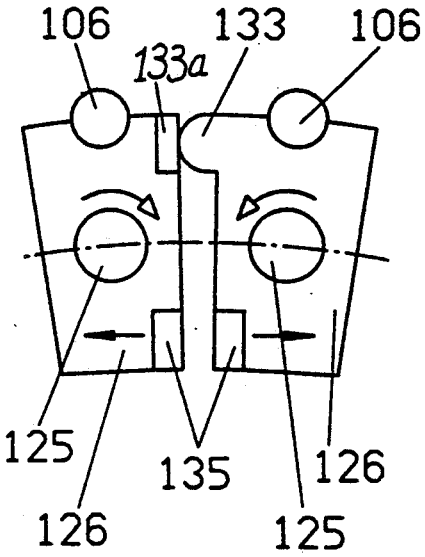
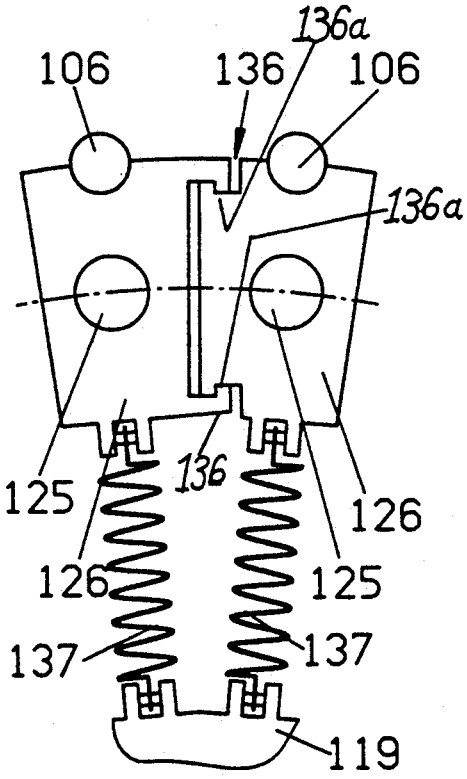
Fig.3c
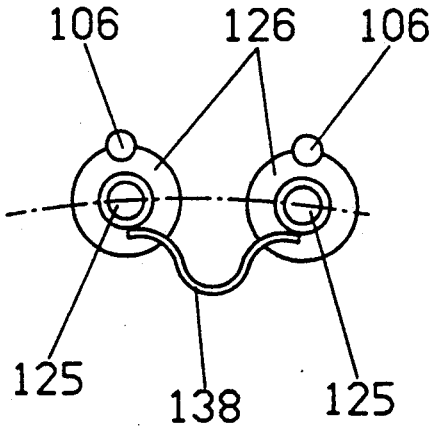
Fig.3d

APPARATUS FOR ALTERING THE SPACING BETWEEN PAIRS OF COAXIAL ROD-SHAPED ARTICLES OF THE TOBACCO PROCESSING INDUSTRY

BACKGROUND OF THE INVENTION

The invention relates to improvements in apparatus for manipulating rod-shaped articles of the tobacco processing industry. More particularly, the invention relates to improvements in apparatus for changing the distance or spacing between sets (e.g., pairs) of coaxial rod-shaped articles including filter rod sections as well as plain or filter cigarettes, cigars, cheroots and cigarillos.

It is often necessary to transport rod-shaped articles of the tobacco processing industry (hereinafter called cigarettes for short) in the form of rows of parallel cigarettes wherein each cigarette of one row is coaxial with one cigarette of each other row. For example, a modern cigarette making machine of the type known as PROTOS is designed to deliver to a filter tipping machine two rows of parallel plain cigarettes wherein each cigarette of one row is coaxial with a cigarette of the other row and the coaxial cigarettes form pairs of closely or immediately adjacent cigarettes. The spacing between such pairs of coaxial cigarettes must be increased in the filter tipping machine in order to provide room for the introduction of a filter plug or filter rod section of double unit length. Each of the thus inserted filter plugs is then connected with the adjacent plain cigarettes by an adhesive-coated uniting band consisting of so-called tipping paper, and the thus obtained filter cigarettes of double unit length are severed midway between their ends (i.e., across the convoluted uniting bands and across the filter plugs) to yield pairs of filter cigarettes of unit length each having a plain cigarette, a filter plug of unit length, and one half of the respective convoluted uniting band.

Spreading of pairs of coaxial cigarettes is also necessary in certain makes of filter tipping machines. Thus, when successive filter cigarettes of double unit length are severed to yield pairs of filter cigarettes of unit length, it is often necessary to move the filter cigarettes of each pair axially and away from each other so that each of the thus separated filter cigarettes of unit length can be conveniently advanced to a discrete testing conveyor to undergo one or more tests including ascertaining the integrity of its wrapper, the permeability of its wrapper to atmospheric air, the condition of the seam, the resistance of the tobacco filler to the flow of tobacco smoke and/or other parameters which are important to the manufacturer and particularly to the consumer.

Published German patent application Serial No. 38 17 740 discloses an apparatus wherein the spreading unit which is used to increase the spacing between successive pairs of coaxial cigarettes or analogous rod-shaped articles of the tobacco processing industry employs two conical drums which taper in opposite directions. A drawback of such apparatus is that the conical drums occupy a substantial amount of space which is at a premium between a cigarette making machine and a filter tipping machine as well as in the interior of a filter tipping machine.

OBJECTS OF THE INVENTION

An object of the invention is to provide a simple, compact and relatively inexpensive apparatus which can alter the spacing between successive sets (e.g., pairs) of coaxial rod-shaped articles of the tobacco processing industry.

Another object of the invention is to provide an apparatus which can be used with advantage in or ahead of a filter tipping machine in a production line for mass production of filter cigarettes, cigars, cigarillos or other rod-shaped articles of the tobacco processing industry.

A further object of the invention is to provide the apparatus with novel and improved means for delivering cigarettes from a first conveyor serving to deliver sets of coaxial cigarettes at a first spacing (e.g., zero) from each other to a second conveyor wherein the distance between the coaxial articles departs from the original distance.

An additional object of the invention is to provide an apparatus wherein the articles are manipulated in such a way that their appearance and/or any other desirable characteristic is not affected during movement of articles with the first conveyor, from the first conveyor to the second conveyor, and with the second conveyor.

Still another object of the invention is to provide the apparatus with novel and improved means for driving selected parts of the means for delivering articles from the first conveyor to the second conveyor.

A further object of the invention is to provide a filter tipping machine which embodies the above outlined apparatus.

Another object of the invention is to provide a production line which embodies one or more apparatus of the above outlined character.

An additional object of the invention is to provide an apparatus which need not change the orientation of articles during advancement toward, at or downstream of the spreading or condensing station.

Still another object of the invention is to provide a novel and improved method of altering the distance between successive pairs of plain cigarettes or filter cigarettes in a production line.

A further object of the invention is to provide novel and improved means for effecting the change in mutual spacing of pairs of coaxial rod-shaped articles of the tobacco processing industry in a small area and at a frequency which is required in a modern production line for plain cigarettes, filter cigarettes and/or other rod-shaped articles of the tobacco processing industry.

SUMMARY OF THE INVENTION

The invention is embodied in an apparatus for changing the distance between successive sets of coaxial rod-shaped articles of the tobacco processing industry which are supplied as rows of parallel articles and wherein each set includes a first article forming part of one of the rows and a second article forming part of another row. The improved apparatus comprises a first conveyor rotatable about a first axis and having means for transporting successive rows of articles to a transfer station, a second conveyor rotatable about a second axis (which can be parallel to the first axis) and having means for receiving successive sets of articles at the transfer station, and means for delivering the first articles of successive sets from the transporting means of the first conveyor to the receiving means of the second conveyor with simultaneous shifting of the first articles axially relative to the respective second articles. The delivering means comprises first and second motion transmitting members rotatable about additional axes which are inclined relative to the first and second axes, means for rotating the members, and means for coupling the members including article transferring elements.

The first and second conveyors can include drums having peripheral flutes which constitute or form part of the transporting and receiving means, respectively. The motion transmitting members can be substantially parallel to each other, and the article transferring elements of the coupling means can be provided with flutes for the first articles of the sets of coaxial articles.

The coupling means preferably comprises cranks including pins having end portions supporting the article transferring elements. The axes of the pins can be parallel to the first and second axes.

The additional axes (of the motion transmitting members) can be spaced apart from and parallel to each other.

The means for rotating the motion transmitting members can include means for driving one of the motion transmitting members and the coupling means can comprise the aforementioned pins which rotate the other motion transmitting member in response to rotation of the one motion transmitting member. In accordance with a presently preferred embodiment of the invention, the coupling means comprises cranks including eccentric pins with end portions which support the article transferring elements. The pins of such cranks are rotatably journalled in at least one of the motion transmitting members.

As mentioned above, the article transferring elements can include flutes for first articles. The pins of the cranks are rotatably journalled in the first and/or second motion transmitting member and each such pin has means for rotatably mounting one of the article transferring elements. The at least one motion transmitting member can be provided with guide slots for portions of the crank pins, and the mounting means can include bearings which rotatably journal the crank pins in the at least one motion transmitting member.

The delivering means preferably further comprises means for preventing changes of orientation of the article transferring elements. Such preventing means can comprise means for confining the article transferring elements to translatory movements relative to each other. The confining means can include means for preventing rotation of the article transferring elements relative to each other.

In accordance with another presently preferred embodiment of the improved apparatus, the rotating means of the article delivering means comprises means for driving one of the motion transmitting members including a rotary input element and a cardan joint between the input element and the one motion transmitting member. A presently preferred cardan joint comprises a first shaft which receives motion from and extends transversely to the input element of the driving means. The coupling means can comprise pins which are movably mounted in the other motion transmitting member and each of which supports one of the article transferring elements. The rotating means of article delivering means in such apparatus further comprises additional shafts mounted in the one motion transmitting member and each articulately connected with one of the pins. The other motion transmitting member can be provided with spherical bearings for the pins. In such apparatus, the axis of rotation of drive means for one of the one motion transmitting members can coincide with the axis of one of the conveyors.

The apparatus can further comprise a third conveyor having flutes or other suitable means for transferring second articles of successive sets from the first conveyor to the second conveyor so that the second articles bypass the article delivering means.

The first axis can be parallel to the second axis, and the third conveyor can include a further drum rotatable about an axis which is parallel to the first and second axes.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 3*a* illustrates a detail in an apparatus of the type shown in FIG. 2;

FIG. 3*b* illustrates a first modification of the structure which is shown in FIG. 3*a;*

FIG. 3*c* illustrates a second modification of the structure which is shown in FIG. 3*a;*

FIG. 3*d* illustrates a third modification of the structure which is shown in FIG. 3*a*.

DESCRIPTION OF PREFERRED EMBODIMENTS

Figure 1:
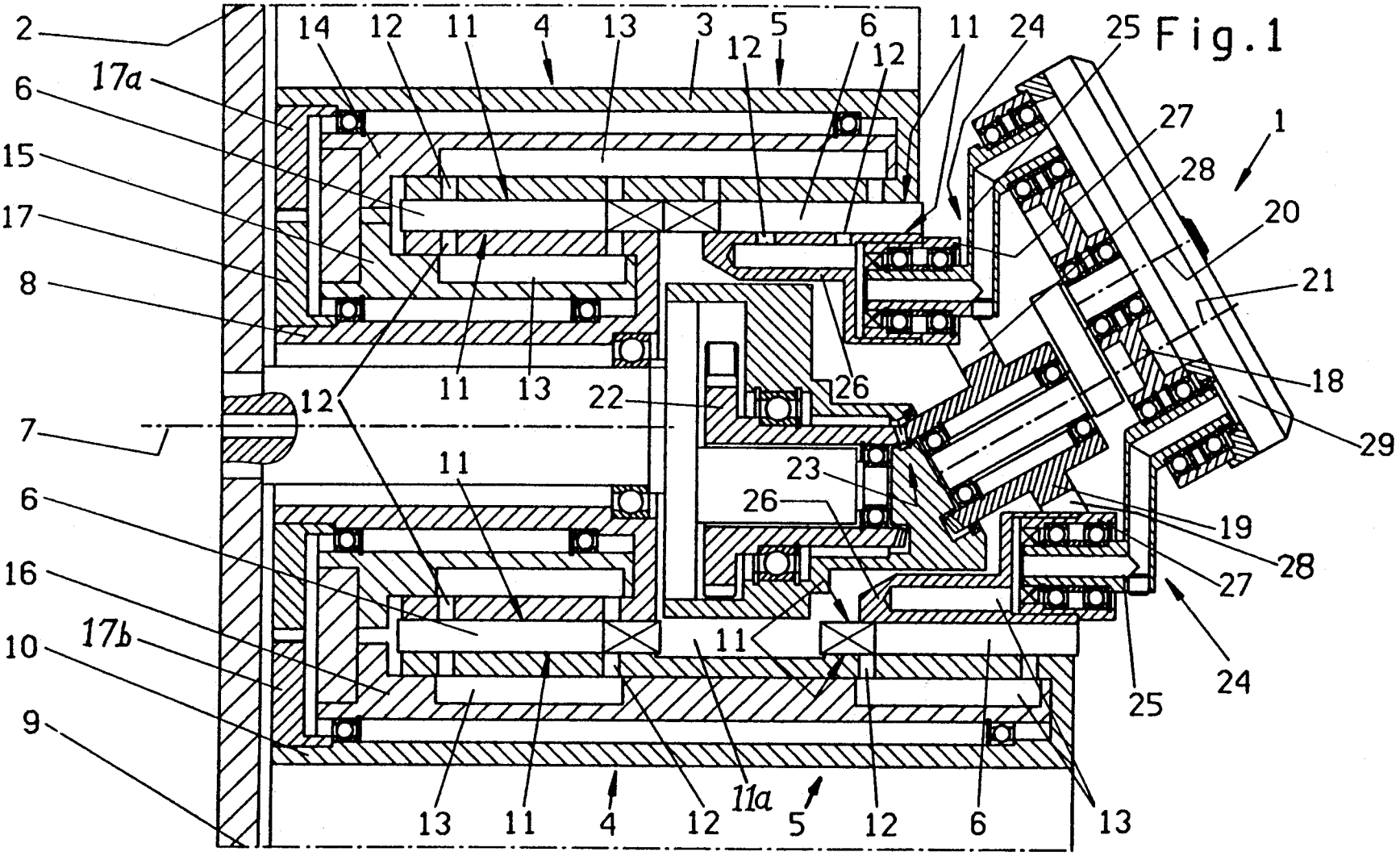
FIG. 1 is a fragmentary schematic central sectional view of an apparatus which embodies one form of the invention and wherein the means for delivering first articles of successive sets of coaxial articles from the first conveyor to the second conveyor comprises two parallel motion transmitting members rotatable about parallel axes.

The apparatus which is shown in FIG. 1 comprises a first rotary drum-shaped conveyor 3 having axially parallel peripheral flutes 11 serving as a means for transporting successive pairs (sets) of coaxial rod-shaped articles 6 (such as plain cigarettes) from the outlet of a cigarette making machine (not shown) to a transfer station accommodating a (third) rotary drum-shaped conveyor 8. The apparatus further comprises a (second) rotary drum-shaped conveyor 10 which receives pairs of coaxial cigarettes 6 in part from the conveyor 8 and in part from a novel and improved article delivering conveyor or unit 1. The arrangement is such that one (namely the left-hand) cigarette 6 of each pair of cigarettes delivered by successive article transporting flutes 11 of the first conveyor 3 is transferred into an oncoming article receiving flute 11 of the second conveyor 10, and the other cigarette 6 of each pair is moved axially and away from the one cigarette during delivery from the respective flute 11 of the conveyor 3 to the oncoming flute 11 of the conveyor 10. The axis 2 of the first conveyor 3 is parallel to the axis 9 of the second conveyor 10 as well as to the axis 7 of the third conveyor 8.

The cigarettes 6 which are to be transferred by the flutes 11 of the third conveyor 8 without any axial shifting form a row 4 of parallel cigarettes, and the cigarettes 6 which are to be delivered by the unit 1 with simultaneous axial shifting form a row 5 of parallel cigarettes.

The flutes 11 of the conveyors 3, 10 and 8 are provided with suitably distributed suction ports 12 which communicate with discrete suction chambers 13 during certain stages of each revolution about the respective axes 2, 9 and 7. This ensures that the cigarettes 6 are reliably attracted to and held in the respective flutes 11 during transfer by the conveyor 8 from the row 4 into successive flutes 11 of the conveyor 10 as well as during delivery from the row 5 into successive flutes 11 of the conveyor 10 (with simultaneous axial shifting away from the respective cigarettes 6 of the row 4. This increases the distance between the pairs of coaxial digarettes 6 in the flutes 11 of the conveyor 10 (as compared with the distance between the cigarettes 6 in the flutes 11 of the conveyor 3) so that the spaces 11*a* between the pairs of cigarettes 6 on the conveyor 10 are sufficient for reception of filter plugs or mouthpieces of double unit length (if the illustrated cigarettes 6 are plain cigarettes of unit length) or for transport of cigarettes to two discrete axially spaced apart testing conveyors (if the cigarettes 6 are filter cigarettes of unit length and the apparatus of FIG. 1 is installed in a filter tipping machine).

The conveyors 3, 10 and 8 respectively rotate around stationary bodies 14, 16 and 15 which define portions of the respective suction chambers 13 and can act as valving elements which establish or interrupt connections between the adjacent suction ports 12 and the respective suction chambers 13, depending on the angular positions of the respective flutes 11 (i.e., depending on the angular positions of the respective conveyors 3, 10 and 8).

The means for rotating the centrally located third conveyor 8 comprises a prime mover (not shown) which drives a gear 17 forming part of a gear train. Such gear train further includes a gear 17*a* which mates with the gear 17 and transmits torque to the first conveyor 3 as well as a gear 17*b* which mates with the gear 17 and transmits torque to the second conveyor 10.

The article delivering unit 1 in the apparatus of FIG. 1 comprises two parallel substantially disc-shaped motion transmitting members 18 and 19 which are respectively rotatable about parallel (additional) axes 20 and 21. These axes are spaced apart from each other and are inclined with reference to the axes 2, 9 and 7 of the respective (first, second and third) rotary conveyors 3, 10 and 8. As can be seen in FIG. 1, the disc-shaped motion transmitting members 18, 19 are offset (eccentric) relative to each other (the eccentricity is determined by the distance of the axes 20 and 21 from each other). The means for rotating the motion transmitting members 18, 19 about their respective axes 20 and 21 comprises a gear 22 which is driven by a suitable prime mover in a manner not forming part of the present invention, and a so-called Hirth gearing 23 which enables the gear 22 (rotating about the axis 7) to drive the inner motion transmitting member 19 about the axis 21 making an oblique angle with the axis 7. The means for rotating the outer motion transmitting member 18 includes cranks 24 which receive motion from the member 19 and cause the member 18 to rotate about the axis 20 in response to rotation of the member 19 about the axis 21.

The cranks 24 are rotatably journalled in the motion transmitting members 18, 19 and comprise pins 25. These cranks can be said to constitute a means for coupling the motion transmitting members 18, 19 to each other with freedom of relative movement, and the pins 25 of the cranks 24 carry article transferring elements 26 with flutes 11 which serve to deliver successive right-hand cigarettes 6 (i.e., successive cigarettes 6 of the row 5) into successive oncoming flutes 11 of the second conveyor 10. The article transferring elements 26 at the ends of the pins 25 of cranks 24 are rotatably journalled in bearings 27 which are installed in the inner motion transmitting member 19 of the article delivering unit 1. The member 19 has substantially radially extending slots or windows 28 for the respective bearings 27. Those portions of the member 19 which are adjacent the slots 28 act not unlike the claws of partly open wrenches in that they enable the bearings 26 to move radially of the member 19 (i.e., radially of the axis 21) but prevent the bearings 26 from turning relative to the member 19. It can be said that at least a portion of the path of each bearing 27 about the axis 21 is a portion of the conical path. The bearings 27 are further free to move in the direction of the axes 2, 9 and 7 so that they can move the respective flutes 11 axially and away from the third conveyor 8 during delivery of a cigarette 6 of the row 5 from the flutes 11 of the conveyor 3 to the flutes 11 of the conveyor 10. Otherwise stated, the walls surrounding the elongated radially or nearly radially extending slots or windows 28 in the motion transmitting member 19 act not unlike a means for preventing changes of orientation of cigarettes 6 which are being delivered from the row 5 into the flutes 11 of the conveyor 10. In other words, the cigarettes 6 which are being delivered by the flutes 11 of the elements 26 remain parallel to the cigarettes 6 of the row 4 but move axially and away from the row 4 whose cigarettes 6 are being transferred (in the apparatus of FIG. 1) by the flutes 11 of the third conveyor 8 without any axial shifting.

In order to ensure reliable retention of cigarettes 6 in optimum orientation during delivery from the row 5 into the flutes 11 of the conveyor 10, the flutes 11 of the elements 26 on the pins 25 of the cranks 24 are also provided with suction ports 12 in communication with a suction chamber 13 which ensures that the cigarettes 6 are attracted to the surfaces bounding the flutes 11 of the elements 26 during certain stages of each orbital movement of each such element about the axis 21 of the inner motion transmitting member 19 of the article delivering unit 1. The suction ports 12 for the flutes 11 of the elements 26 communicate with the respective suction chamber 13 by way of channels, bores or other suitable passages in the hollow cranks 24. A stationary control member or valving element 29 is associated with the motion transmitting member 18 to ensure that the suction ports 12 in the flutes 11 of the article transferring elements 26 are sealed from the respective suction chamber 13 during certain stages of orbital movement of the elements 26, for example, when the cigarettes 6 of the row 5 are in the process of entering the flutes 11 of the second conveyor 10.

The inclination of the axes 20 and 21 relative to the axes 2, 9 and 7 is one of the factors which determine the extent of axial movement of cigarettes 6 of the row 5 on their way from the flutes 11 of the first conveyor 3 into the flutes 11 of the second conveyor 10.

Figure 2:
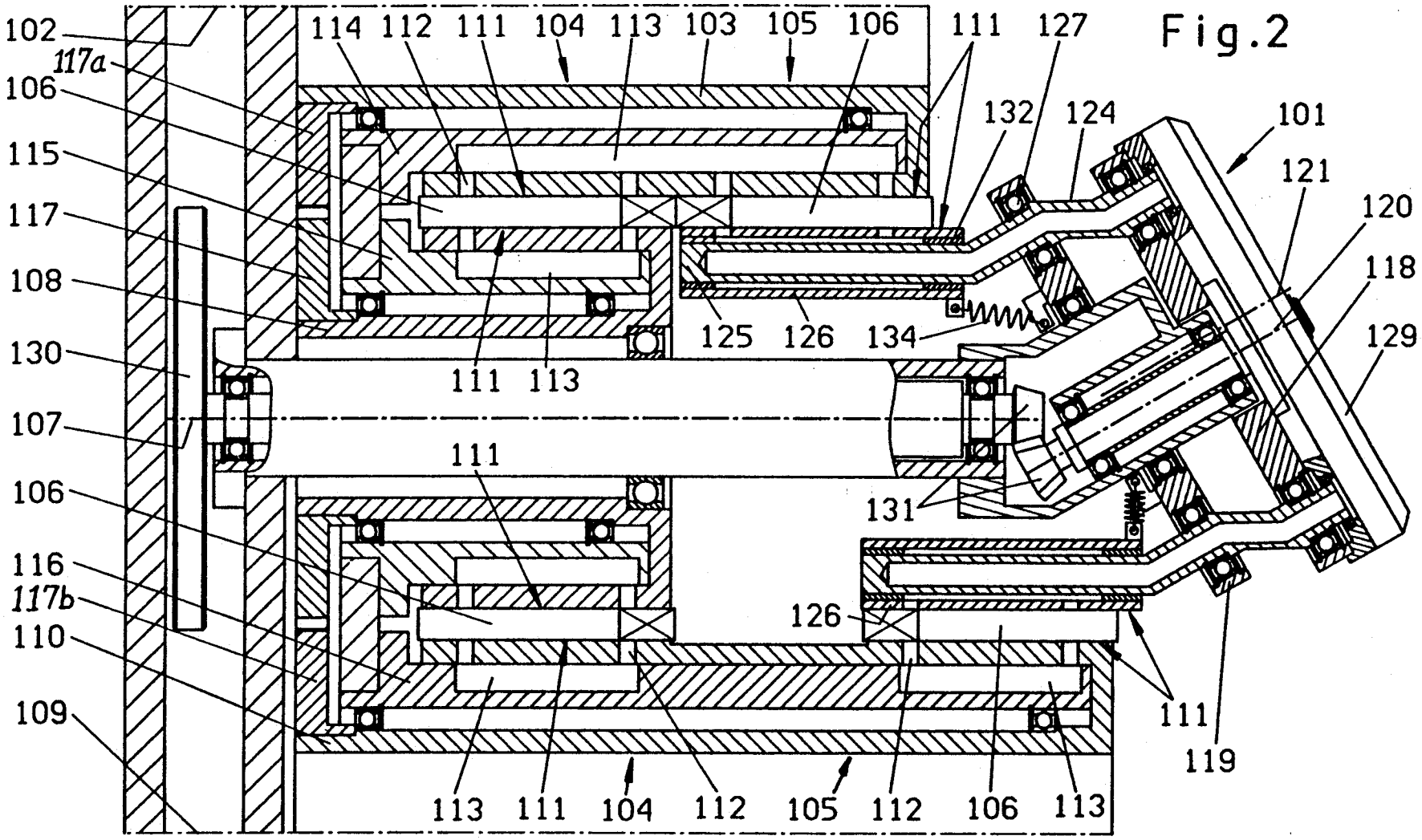
FIG. 2 is a similar fragmentary schematic central sectional view of a second apparatus with modified article delivering means.

FIG. 2 shows a second apparatus employing a modified article delivering unit 101. All such parts of this apparatus which are identical with or clearly analogous to corresponding parts of the apparatus of FIG. 1 are denoted by similar reference characters plus 100.

The means for rotating the motion transmitting members 118, 119 of the delivering unit 101 comprises a centrally located gear 130 whose axis coincides with the axis 107 of the third conveyor 108 and which drives the first or outer motion transmitting member 118 through the medium of a bevel gear transmission 131. The cranks 124 serve as a means for rotating the inner motion transmitting member 119 in response to rotation of the member 118. The article transferring elements 126 are indirectly mounted on the pins 125 of the cranks 124 by bearings 132 so that the pins 125 and the corresponding elements 126 can rotate relative to each other. The bearings 127 serve the sole purpose, or the primary purpose, of rotatably journalling the cranks 124 in the inner disc-shaped motion transmitting member 119 of the delivering unit 101.

Various means for preventing changes of orientation of the flutes 111 on the elements 126 during movement of these elements along arcs of approximately 180° (from the flutes 111 of the first conveyor 103 to the flutes 111 of the second conveyor 110) are illustrated in FIGS. 3*a*, 3*b*, 3*c* and 3*d*.

FIGS. 3 and 3*a* show two neighboring article transferring elements 126 which are held against rotation relative to each other by tensioned coil springs 134 each having one of its end portions attached to a post on the inner motion transmitting member 119 of the delivering unit 101 and an outer end portion attached to one of the elements 126. The springs 134 tend to turn the elements 126 about the pins 125 of the respective cranks 124 in such a way that a projection 133 on one of the neighboring elements 126 is urged against a stop 133*a* of the other element 126. At the same time, the projection 133 and the stop 133*a* permit the elements 126 to move relative to each other in the axial direction of the respective pin 125, i.e., at right angles to the plane of FIG. 3*a*.

FIG. 3*b* illustrates a first modification of the structure of FIGS. 3 and 3*a*. The coil springs 134 are replaced by two permanent magnets 135 which are installed in the neighboring elements 126 and urge the projection 133 on one of these elements against the stop 133*a* on the other element 126. The left-hand magnet 135 tends to turn the left-hand element 126 in a clockwise direction, and the right-hand magnet 135 tends to turn the right-hand element 126 in a counterclockwise direction, i.e., the projection 133 is urged against the stop 133*a* but the elements 126 are again free to move relative to each other in the axial direction of their respective pins 125.

FIG. 3*c* illustrates preventing means which constitute a modification of the structure shown in FIGS. 3 and 3*a*. The left-hand element 126 is provided with two claws 136 which extend into the grooves 136*a* of the right-hand element 126 so that these elements are permanently coupled to each other against angular movement about the respective pins 125. At the same time, the elements 126 are free to move relative to each other in the axial direction of the respective pins 125. The coil springs 137 which are shown in FIG. 3*c* prevent accidental shifting of the article transferring elements 126 along the respective pins 125.

FIG. 3*d* shows a wire-like spring 138 which couples two neighboring article transferring elements 126 to each other so that these elements cannot turn relative to each other or can turn only to a limited extent.

Figure 4:
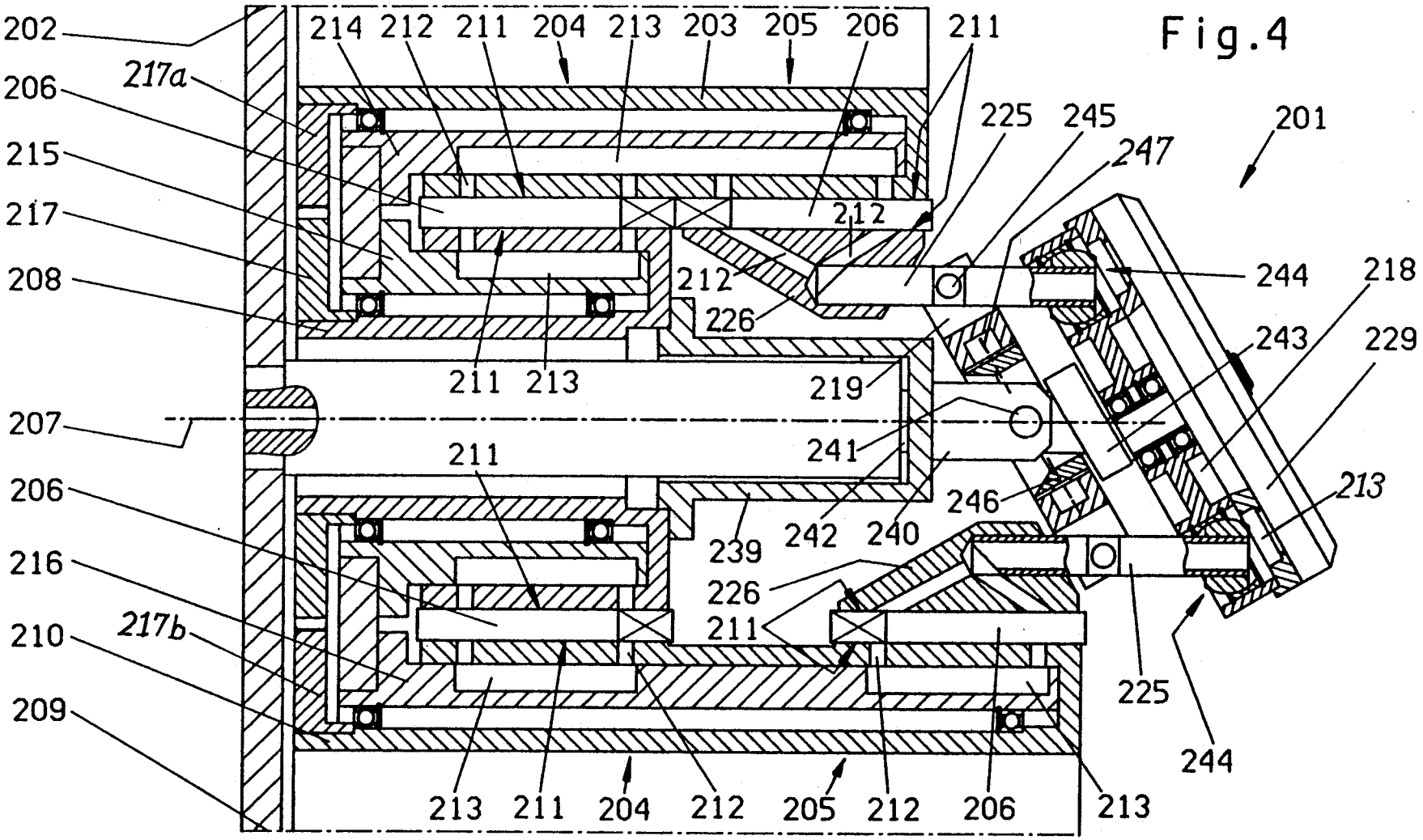
FIG. 4 is a fragmentary schematic central sectional view of a further apparatus.

Referring to FIG. 4 there is shown a further apparatus which employs a different article delivering unit 201. All such parts of this apparatus which are identical with or clearly analogous to corresponding parts of the apparatus of FIG. 1 are denoted by similar reference characters plus 200.

The main difference between the delivering units 1 and 101 on the one hand, and the unit 201 on the other hand, is that the parallel motion transmitting members 218, 219 of the unit 201 are mounted for rotation in response to rotation of an input element about the axis 207 of the third conveyor 208. The inner motion transmitting member 219 of the unit 201 is rotated by the input element including a centrally located hollow drive shaft 239 having an axial extension 240 for a transverse post or shaft 241 serving to establish a torque transmitting connection to the member 219. A post or shaft 242 which extends axially from the shaft 239 is provided with a flange 243 which supports the outer motion transmitting member 218 of the delivering unit 201. The member 218 is rotated by pins 225 which are parallel to the axes 202, 209 and 207. Each of these pins 225 is articulately connected to the member 218 by a spherical joint 244. Additional posts or shafts 245 are provided to couple the pins 225 to the inner motion transmitting member 219. The article transferring elements 226 are non-rotatably connected to the respective pins 225. The connection between the shaft 239 and the inner motion transmitting member 219 further comprises a cardan joint 246 having an axis 247.

An advantage of the improved apparatus is its simplicity. Furthermore, the apparatus is compact and it can manipulate large numbers of sets of coaxial rod-shaped articles 6 or 106 or 206 of the tobacco processing industry per unit of time. This is due to the fact that successive sets of coaxial articles can be closely adjacent each other when they arrive with the first conveyor 3 or 103 or 203 and also because such first conveyor, the other two conveyors and the disc-shaped motion transmitting members of the delivering unit 1, 101 or 201 can be rotated at an elevated speed.

Another important advantage of the improved apparatus is that its mobile parts are not likely to vibrate, even if driven at an elevated speed, that the wear upon the moving parts is minimal and that the apparatus can be installed with advantage in existing filter tipping machines or in existing production lines as a superior substitute for heretofore known apparatus.

A further important advantage of the improved apparatus is that the flutes 11, 111 or 211 of the article transferring elements 26, 126 or 226 can move axially but their orientation remains unchanged at all times. Such flutes can move longitudinally of the flutes in the first and second conveyors but are held against other movements, e.g., in a manner as described with reference to FIGS. 3*a* to 3*d*. Vibratory movements of parts of the article delivering unit 1, 101 or 201 are reduced or prevented because the motion transmitting members of the unit 1, 101 or 201 need not perform any translatory movements. Moreover, the absence of translatory movements reduces the likelihood of extensive wear and contributes to longer useful life of moving parts and to a reduction of down times of the improved apparatus.

The apparatus of FIG. 4 exhibits the advantage that the spherical joints 244 for the pins 225 facilitate convenient connection of suction ports 212 in the flutes 211 of the article transferring elements 226 with the respective suction chamber 213. The provision of a common input element 239 for the two discs 218, 219 also contributes to simplicity and compactness of such apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for changing the distance between successive sets of coaxial rod-shaped articles of the tobacco processing industry which are supplied as rows of parallel articles and wherein each set includes a first article forming part of one of the rows and a second article forming part of another row, comprising a first conveyor having means for transporting successive sets of articles to a transfer station; a second conveyor having means for receiving successive sets of articles at the transfer station, said first and second conveyors being rotatable about first and second axes, respectively; and means for delivering the first articles of successive sets from the transporting means of the first conveyor to the receiving means of the second conveyor with simultaneous shifting of the first articles axially relative to the respective second articles, including first and second motion transmitting members rotatable about additional axes which are inclined relative to said first and second axes, means for rotating said members, and means for coupling said members including article transferring elements.

2. The apparatus of claim 1, wherein said first and second conveyors include drums having peripheral flutes constituting or forming part of said transporting and said receiving means, respectively, said members being substantially parallel to each other and said article transferring elements having flutes for the first articles of said sets of articles.

3. The apparatus of claim 1, wherein said means for rotating said members comprises pins having end portions supporting said article transferring elements.

4. The apparatus of claim 3, wherein said pins have axes which are parallel to said first and second axes.

5. The apparatus of claim 1, wherein said additional axes are spaced apart from and parallel to each other.

6. The apparatus of claim 1, wherein said rotating means includes means for driving one of said members, said coupling means comprising pins which rotate the other of said members in response to rotation of said one member.

7. The apparatus of claim 1, wherein said coupling means comprises cranks including eccentric pins having end portions supporting said article transferring elements, said pins being rotatably journalled in said members.

8. The apparatus of claim 1, wherein said article transferring elements have flutes for first articles, said coupling means further comprising crank pins rotatably journalled in at least one of said members and each having means for rotatably mounting one of said elements.

9. The apparatus of claim 8, wherein said at least one member has guide slots for portions of said crank pins, said mounting means including bearings rotatably journalling said crank pins in said at least one member.

10. The apparatus of claim 1, wherein said delivering means further comprises means for preventing changes of orientation of said article transferring elements.

11. The apparatus of claim 10, wherein said means for preventing changes of orientation comprises means for confining said elements to translatory movements relative to each other.

12. The apparatus of claim 11, wherein said confining means includes means for preventing rotation of said elements relative to each other.

13. The apparatus of claim 1, wherein said rotating means comprises means for driving one of said members including a rotary input element and a cardan joint between said input element and said one member.

14. The apparatus of claim 13, wherein said cardan joint comprises a first shaft receiving motion from and extending transversely of said input element of said driving means, said coupling means comprising pins movably mounted in the other of said members and each supporting one of said article transferring elements, said rotating means further comprising additional shafts mounted in said one member and each articulately connected with one of said pins.

15. The apparatus of claim 14, wherein said other member comprises spherical bearings for said pins.

16. The apparatus of claim 13, wherein the additional axis of said input element is parallel with the axis of at least one of said conveyors.

17. The apparatus of claim 1, further comprising a third conveyor having means for transferring second articles from said first conveyor to said second conveyor.

18. The apparatus of claim 1, wherein said first axis is parallel to said second axis.

* * * * *